US005850983A

United States Patent [19]

Pöppinghaus

[11] Patent Number: 5,850,983

[45] Date of Patent: Dec. 22, 1998

[54] TRAVERSING YARN GUIDE FOR WINDING MACHINES WITH REVERSING SCREWTHREAD SHAFT HAVING AN ENDLESS SCREWTHREAD GROOVE

[75] Inventor: Winfried Pöppinghaus, Bad Sooden-Allendorf, Germany

[73] Assignee: Georg Sahm GmbH & Co. KG, Eschwege, Germany

[21] Appl. No.: 944,931

[22] Filed: Oct. 2, 1997

[30] Foreign Application Priority Data

Oct. 15, 1996 [DE] Germany ..... 196 424 739.26

[51] Int. Cl.[6] ..... B65H 54/28

[52] U.S. Cl. ..... 242/483.7

[58] Field of Search ..... 242/483.7, 483.5, 242/482.8, 482.9

[56] References Cited

U.S. PATENT DOCUMENTS

| | | | |
|---|---|---|---|
| 2,251,838 | 8/1941 | Baker | 242/483.7 X |
| 3,086,722 | 4/1963 | Altice et al. . | |
| 3,451,640 | 6/1969 | Kieronski et al. | 242/483.7 X |
| 3,854,343 | 12/1974 | May | 242/483.7 X |
| 3,937,102 | 2/1976 | Allen | 242/483.7 X |
| 4,685,637 | 8/1987 | Stitz | 242/483.7 X |

FOREIGN PATENT DOCUMENTS

| | | |
|---|---|---|
| 13 66 169 | 12/1964 | France . |
| 18 09 662 | 6/1970 | Germany . |
| 22 12 053 | 9/1973 | Germany . |
| 37 21 139 | 8/1994 | Germany . |
| 447 902 | 3/1968 | Switzerland . |

*Primary Examiner*—Michael Mansen

*Attorney, Agent, or Firm*—Thomas, Kayden, Horstemeyer & Risley

[57] ABSTRACT

A traversing yarn guide (1) for winding machines with a reversing screwthread shaft (8) having an endless screwthread groove (14), including a main body (2) which is rectilinearly reciprocably guided on two guide rails (5, 6) and which on the one hand carries a yarn guide (3) and which on the other hand has a guide projection (12) projecting into the screwthread groove (14) of the reversing screwthread shaft (8). The traversing yarn guide further comprises a shuttle (17) which is mounted pivotably on the main body (2) and which engages into the screwthread groove (14) of the reversing screwthread shaft (8). The guide projection (12) of the main body (2) is in the form of a cylindrical pin (13) which is arranged co-axially with respect to the axis (11) of the main body (2) and which is adapted with slight clearance to the cross-sectional shape of the screwthread groove (14). The shuttle (17) is of a substantially smaller height in comparison with the height of the screwthread groove (14) and is mounted pivotably in an outside groove (16) in the pin (13).

15 Claims, 2 Drawing Sheets

TRAVERSING YARN GUIDE FOR WINDING MACHINES WITH REVERSING SCREWTHREAD SHAFT HAVING AN ENDLESS SCREWTHREAD GROOVE

FIELD OF THE INVENTION

The invention concerns a traversing yarn guide for winding machines with a reversing screwthread shaft having an endless screwthread groove, comprising a main body which is rectilinearly reciprocably guided on two guide rails and which on the one hand carries a yarn guide and which on the other hand has a guide projection projecting into the screwthread groove of the reversing screwthread shaft, and a shuttle which is mounted pivotably on the main body and which engages into the screwthread groove of the reversing screwthread shaft. Traversing yarn guides are essential components of yarn guide mechanisms with a reversing screwthread shaft, in particular high-speed yarn guide mechanisms.

BACKGROUND OF THE INVENTION

A traversing yarn guide of the kind described in the opening part of this specification is known from German laid-open application (DE-OS) No. 18 09 662. The traversing yarn guide has a main body which engages with its greatest width into two guide grooves, of a U-shaped configuration, in guide rails, so that it is guided reciprocably therein. The main body does not come into contact with the outside diameter of the reversing screwthread shaft. At its end remote from the reversing screwthread shaft the main body carries a yarn guide into which the yarn to be laid is engaged. The main body of the traversing yarn guide has a guide projection which projects into the endless screwthread groove of the reversing screwthread shaft. The guide projection is arranged on one side in eccentric relationship with the axis, extending radially with respect to the reversing screwthread shaft, of the main body of the traversing yarn guide. That guide projection extends rearwardly in a pointed configuration in opposite relationship to the direction of travel of the traversing yarn guide. The guide projection is approximately of a height which corresponds to half the depth of the screwthread groove of the reversing screwthread shaft. Associated with the main body of the traversing yarn guide is a shuttle which is in a ship's hull-like configuration and which extends approximately over the other half of the height of the screwthread groove in the screwthread shaft. That shuttle is also adapted with its outside contour to the width of the screwthread groove. It is arranged eccentrically with respect to the axis of the traversing yarn guide, while it has a rotary axis portion which is inserted into a bore in the main body so that in that way the shuttle can rotate with respect to the main body, as is required for interplay with its rotatingly driven reversing screwthread shaft. Both the shuttle and also the guide projection of the traversing yarn guide engage into the screwthread groove in the reversing screwthread shaft and are guided against the side walls of the groove. The side walls of the screwthread groove in the reversing screwthread shaft do not represent a flat surface but a surface which is curved in a screw pitch-like configuration. In order to provide for line or surface contact between the guide projection of the main body and the shuttle on the one hand and the side walls of the screwthread groove on the other hand, a complicated configuration is required in those two regions. The pointed shaping of the guide projection is matched to the inclination or pitch of the screwthread groove of the reversing screwthread shaft so that such a traversing yarn guide can only be used for a given fixed pitch of the screwthread groove in a reversing screwthread shaft.

DE 37 21 139 C2 discloses a traversing yarn guide comprising a plurality of parts. The division is made between a slide and a shuttle body, wherein the shuttle body not only fills the height of the screwthread groove but in addition it also has a pin-like carrier engaging into a corresponding bore in the slide so that it is at that location outside the screwthread groove that the pivotably movable connection between the parts occurs. The slide itself has U-shaped grooves into which guide rails engage so that the traversing yarn guide is guided here with a rectilinear reciprocating movement. Provided on the carrier of the shuttle body is a guide projection which can be of a cylinder-like shape and projects into the screwthread groove of the reversing screwthread shaft. On the guide projection, the actual shuttle body is embodied by head portions which are guided not only against the side walls of the screwthread groove but also against the bottom of the groove. Thus, guide surfaces are formed between the shuttle and the screwthread groove in order to achieve a uniform surface pressure at the side walls of the screwthread groove. The head portions can be resilient with respect to the guide projection in order to provide for adaptation to the reversal radii at the locations at which the screwthread groove reverses its direction. That known traversing yarn guide is of a relatively large mass which if need be can be reduced by the bow-like tips of the shuttle-like head portions being removed or omitted. The head portions must be of a relatively complicated configuration for surface contact with the side wall and the bottom of the screwthread groove. The head portions forming the shuttle extend over the entire height of the screwthread groove. By virtue of the slide being guided in U-shaped grooves, this traversing yarn guide is also of a relatively great height, combined with a correspondingly large mass. That disadvantage occurs to an increased degree if the actual shuttle is also of a multi-part configuration and its individual parts have to be held together by resilient clamping straps or the like.

Traversing yarn guides are also known, in which the main body comprises a plastic moulding which is fixedly connected to a yarn guide in the form of a ceramic portion. The main body is provided with a lozenge-shaped guide portion forming two pairs of parallel guide surfaces in order to permit pivotal movement of the main body relative to the guide rails at the reversal points of the screwthread groove in the reversing screwthread shaft. Here however the main body of the traversing yarn guide is already advantageously mounted between the outside diameter of the reversing screwthread shaft and the guide rails. The shuttle associated with the main body is adapted to the cross-section of the screwthread groove, with corresponding slight clearance. That traversing yarn guide is already of a relatively smaller mass so that it appears to be better suited to high-speed yarn guide mechanisms. However the arrangement of the lozenge-shaped guide portion also again involves a certain structural size, with corresponding mass.

The object of the present invention is to provide a traversing yarn guide which is suitable in particular for high-speed yarn guide mechanisms and which permits a comparatively smaller and lighter structural configuration and which can be used independently of the pitch of the screwthread groove of the reversing screwthread shaft.

SUMMARY OF THE INVENTION

In accordance with the invention in a traversing yarn guide of the kind described in the opening part of this specification that is achieved in that the guide projection of the main body is in the form of a cylindrical pin which is arranged co-axially with respect to the axis of the main body and which is adapted with slight clearance to the cross-sectional shape of the screwthread groove, and that the shuttle is of a substantially smaller height in comparison with the height of the screwthread groove and is mounted pivotably in an outside groove in the pin.

The basic starting point for the invention is the notion that the functions of the individual parts of the traversing yarn guide can be clearly separated from each other. The guide projection of the main body is embodied in the form of a cylindrical pin, the outside periphery of which is therefore cylindrical and is adapted with slight clearance to the cross-sectional shape of the screwthreaded groove. This means that the main body of the traversing yarn guide is freely rotatable about its axis in the condition of being fitted into the screwthread groove in the reversing screwthread shaft. That rotatability is only limited by the guide rails. The shuttle is the only part which performs a pivotal movement relative to the axis of the traversing yarn guide, as occurs when passing through the reversal points of the screwthread groove in the reversing screwthread shaft. The mass of the shuttle is kept down to an optimum value, more specifically by virtue of the fact that the height of the shuttle makes up only a fraction of the height of the screwthread groove and the entire shuttle is of a substantially "hollow" configuration. In a preferred embodiment the shuttle may comprise a bent shaped wire portion. The contact surfaces or better contact points or at most contact lines of relatively short extent, at which the shuttle comes into contact with the side walls of the screwthread groove, are here deliberately kept small. The shuttle is pivotably fitted into an outside groove of the pin. The configuration of the peripherally extending outside groove on the pin is matched to the pivotably movable mounting of the shuttle on the pin. The configuration may also be such that in the region of the outside groove of the pin the shuttle projects by a small amount relative to the outside diameter of the pin so that in this region the shuttle also performs a guide function and the contact of the pin against the side walls of the screwthread groove, which contact is in itself in line form, is replaced by guide points.

The shuttle of the traversing yarn guide may be rounded off at least in the contact regions relative to the side walls of the screwthread groove, forming guide points. That provides for the desired bearing contact in point form, and optimum account is taken of the screw pitch-like curvature of the side walls of the screwthread groove. The shuttle itself is of an optimally low mass.

If the main body of the traversing yarn guide is guided between the outside diameter of the reversing screwthread shaft and the guide rails, that advantageously provides that the traversing yarn guide is of a low structural height, which also promotes a small light design configuration.

The main body of the traversing yarn guide may be at its greatest width between the outside diameter of the reversing screwthread shaft and the guide rails, and in a direction towards the yarn guide may carry a bar-shaped projection which forms only two parallel guide surfaces for contact with the guide rails. That advantageously eliminates a lozenge-like shaped guide portion of which two pairs of parallel guide surfaces must there be necessarily disposed in succession, which increases the structural length of the traversing yarn guide. In that respect, in the region of the greatest width of the main body of the traversing yarn guide, a disc-like or block-like collar or shoulder projects beyond the width of the screwthread groove of the reversing screwthread shaft. That collar or shoulder is also wider than the spacing between the two guide surfaces.

It is readily possible for a plurality of shuttles to be separately pivotably mounted in outside grooves in the pin of the main body. Admittedly, the provision of a plurality of shuttles disadvantageously increases the mass of the traversing yarn guide, but there is the advantage that the acceptance of slightly different rotational angles of the shuttles relative to the axis of the main body of the traversing yarn guide so-to-speak of itself affords perfect adaptation of the contact points to the curved surface of the side wall of the screwthread groove of the reversing screwthread shaft. Special machining or an expensive configuration operation is here completely eliminated. In particular the shuttle or shuttles may comprise a wire loop member or a corresponding shaped portion or moulding and can be of a resilient nature for the purposes of fitting into the outside groove in the pin. The shuttle can be fitted by snapping engagement onto the outside groove in the pin of the main body of the traversing yarn guide, in a similar manner to a securing ring or circlip, and can thus be pivotably movably arranged in the intended relative position.

The shuttle should be of a symmetrical configuration relative to the axis of the main body or should have at least four guide points arranged symmetrically relative to the axis of the main body. This provides for a good guidance effect for the shuttle in the screwthread groove of the reversing screwthread shaft, and it is immaterial whether the shuttle in terms of its use is fitted into the reversing screwthread shaft in a position of being pivoted through 180°, or not. The shuttle may be of a spherically curved outside contour. That configuration is particularly desirable in order to make the shuttle relatively independent of the magnitude of the reversal radii of the reversing screwthread shaft. In the case of different reversing screwthread shafts with different reversal radii, the guide points are only formed at different locations, on that spherically curved outside contour.

The main body can be of a hollow configuration. That contributes to a further reduction in weight without the pivotable mounting of the shuttle on the pin of the main body being disadvantageously affected in that way.

BRIEF DESCRIPTION OF THE DRAWINGS

The invention will be further described by means of preferred embodiments. In the drawing.

DETAILED DESCRIPTION

Figure 1:
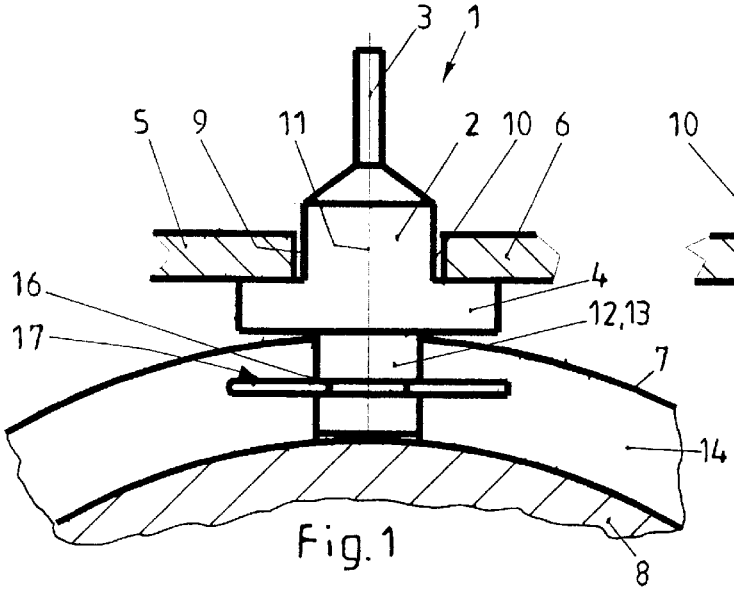
FIG. 1 is a view in section through the reversing screwthread shaft with a view of the traversing yarn guide.
Figure 2:
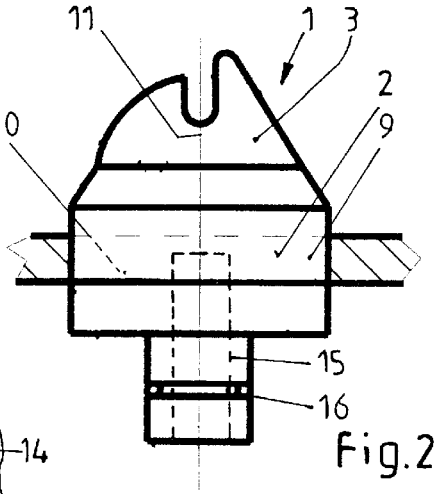
FIG. 2 shows the traversing yarn guide of FIG. 1 in a position in which it is turned through 90°.
Figure 6:
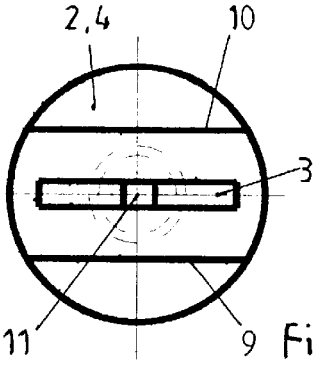
FIG. 6 shows a plan view of the traversing yarn guide of FIG. 2.

The traversing yarn guide 1 has a main body 2 which is preferably produced in the form of a plastic moulding. The actual yarn guide 3 which is preferably in the form of a ceramic moulding and which is of the configuration shown in particular in FIG. 2 is let into or fixedly connected to the main body 2. The main body 2 has in its central portion a collar or shoulder 4 in which the main body 2 is at its greatest width (FIG. 1). The traversing yarn guide 1 is guided between two guide rails 5 and 6 on the one hand and the outside diameter 7 of the reversing screwthread shaft 8 so that its centre of gravity is moved as closely as possible to the reversing screwthread shaft 8. Conversely that results in a low structural height with the correspondingly low weight. The main body 2 has two guide surfaces 9 and 10 by means of which it is rectilinearly reciprocably guided on the guide rails 5 and 6. As a lozenge-shaped guide portion is eliminated here and it is only necessary to provide two parallel guide surfaces 9 and 10, the traversing yarn guide 1 is of a comparatively short structural length (FIGS. 2 and 6). The collar or shoulder 4 can be in the form of a disc (FIG. 6) around the axis 11 or it may also be in the form of a plate-like body of rectangular configuration. A round disc-like configuration presents itself in order to keep the weight of the traversing yarn guide 1 low.

The main body 2 of the traversing yarn guide 1 has a guide projection 12 in the form of a cylindrical pin 13 with which it projects into the screwthread groove 14 at least over a large part of the height of the screwthread groove 14, preferably without touching the bottom of the screwthread groove 14. It is however also possible for the pin 13 to be of such a length that it deliberately touches the bottom of the screwthread groove 14 so that contact of the collar or shoulder 4 with the outside diameter 7 of the reversing screwthread shaft is then not required. To save weight in regard to the main body 2 of the traversing yarn guide 1 the main body 2 and the pin 13 may be hollow, that is to say provided with a recess 15, as is indicated in broken lines in FIG. 2.

Figure 3:
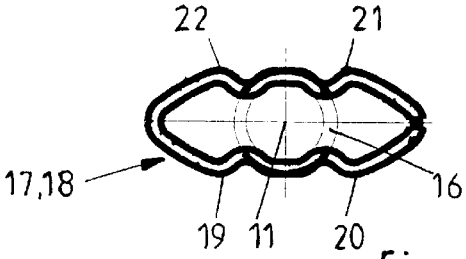
FIG. 3 is a plan view of the shuttle in a first embodiment in the form of a bent wire portion.

The guide projection 12 or the pin 13 has an outside groove 16 in which a shuttle or boat-shaped member 17 is mounted rotatably in itself, although, when the reversing screwthread shaft 8 is driven, the shuttle 17 only performs a pivotal movement corresponding to the pitch or inclination of the screwthread groove 14, about the axis 11. The shuttle 17 can be in the form of a wire loop member 18 (FIG. 3) of the illustrated configuration. The wire loop member 18 is of a circular cross-section and the configuration shown in FIG. 3 so that guide points 19, 20, 21, 22 are formed on each side of the wire loop member 18, at which the shuttle 17 is in respective point contact with a respective side wall of the screwthread groove 14, in dependence on the positive or negative inclination or pitch of the screwthread groove 14. The configuration of the wire loop member 18 is such that, as can be seen, it can also pass through the reversal points of the screwthread groove 14 without the risk of jamming occurring there. This also applies in regard to those screwthread grooves 14 which are also of a constant width in the region of the reversal locations. It can be seen in particular from FIG. 1 that the shuttle 17 is only of a very small height in comparison with the height of the screwthread groove 14. The height of the shuttle 17 can be of the order of magnitude of one-fifth to one-tenth of the height of the screwthread groove 14.

Figure 4:
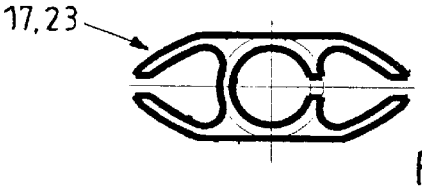
FIG. 4 is a plan view of the shuttle in the form of a stamped portion.

FIG. 4 shows a further embodiment of the shuttle 17 in the form of a shaped portion 23. The shaped portion 23 can be produced from spring steel sheet, similarly to a securing ring or circlip in accordance with DIN 471. Both the wire loop member 18 and also the shaped portion 23 can be fitted by snapping engagement into the outside groove 16 in the pin 13.

Figure 5:
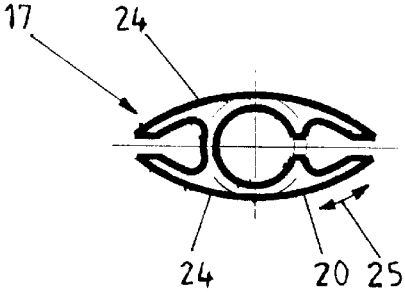
FIG. 5 is a plan view of a shuttle in the form of a stamped portion with a spherically curved outside contour.

FIG. 5 shows a further embodiment of the shuttle 17 with a spherically curved outside contour 24, the radius of which is smaller than or equal to the reversal radii of the reversing screwthread shaft 8. Consequently, the reversal points are in different positions depending on the respective reversal radii used. This is illustrated by a double-headed arrow 25 in regard to the guide point 20.

Figure 7:
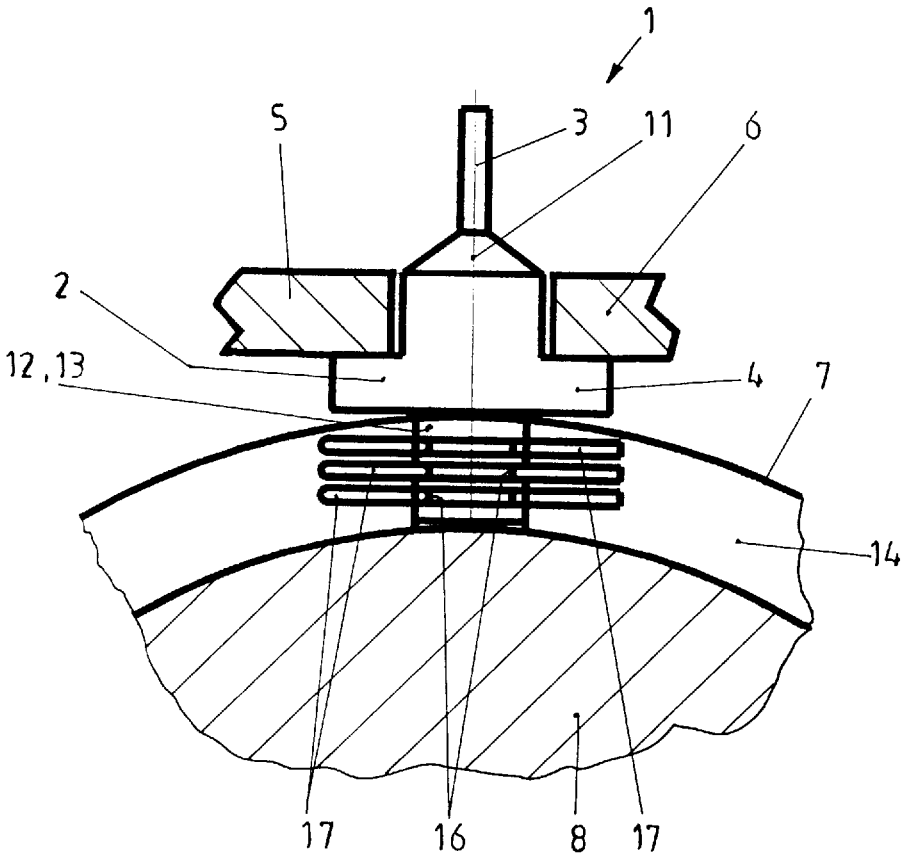
FIG. 7 shows a further embodiment of the traversing yarn guide provided with three shuttles.

FIG. 7 shows an embodiment in which three shuttles 17 are mounted in three outside grooves 16 at spacings from each other and thus separately from each other pivotably on the pin 13 of the main body 2 of the traversing yarn guide 1. As the side walls of the screwthread groove 14 represent a curved surface the shuttles 17, upon coming into contact with the side wall in the screwthread groove 14, will set themselves in a position of being turned relative to each other about the axis 11 through a slight angle, and thus form respectively different contact points 19, 20 and 21, 22 respectively. This arrangement therefore provides for adaptation to that curved surface by the shuttles 17 automatically and without special machining.

While the foregoing specification and drawing set forth preferred embodiments of the invention, it will be understood by those skilled in the art that variations and modifications thereof can be made without departing from the spirit and scope of the invention as set forth in the following claims.

What is claimed is:

1. A traversing yarn guide for a winding machine with a reversing screwthread shaft having an endless screwthread groove and with first and second guide rail means for the yarn guide, comprising a main body adapted to be rectilinearly reciprocably guided on the guide rail means, a yarn guide carried on the main body, a guide projection on the main body adapted to project into the screwthread groove of the reversing screwthread shaft, the guide projection on the main body being in the form of an at least substantially cylindrical pin having an outside surface and arranged at least substantially co-axially with respect to the axis of the main body and adapted with slight clearance to the cross-sectional shape of the screwthread groove, a groove in the outside surface of the pin, and a shuttle means mounted pivotably on the main body and adapted to engage into the screwthread groove of the reversing screwthread shaft, the shuttle means being of a substantially smaller height in comparison with the height of the screwthread groove and mounted pivotably in the outside groove in the pin.

2. A traversing yarn guide as set forth in claim 1 wherein the shuttle means is rounded-off at least in its contact regions relative to the side walls of the screwthread groove thereby forming guide points.

3. A traversing yarn guide as set forth in claim 1 wherein the main body is adapted to be guided between the outside diameter of the reversing screwthread shaft and the guide rail means.

4. A traversing yarn guide as set forth in claim 3 wherein the main body is at its greatest width between the outside diameter of the reversing screwthread shaft and the guide rail means and in a direction towards the yarn guide carries a bar-shaped projection which forms only first and second at least substantially parallel guide surfaces for contact with the guide rail means.

5. A traversing yarn guide as set forth in claim 1 wherein the outside surface of said pin of the main body has plurality of grooves therein, including a plurality of shuttles means separately pivotably mounted in said grooves of the pin of the main body.

6. A traversing yarn guide as set forth in claim 5 wherein each shuttle means comprises a wire loop member and is of a resilient nature for the purposes of fitting into the groove in the pin.

7. A traversing yarn guide as set forth in claim 5 wherein each shuttle means comprises a shaped portion and is of a resilient nature for the purposes of fitting into the groove in the pin.

8. A traversing yarn guide as set forth in claim 1 wherein the shuttle means comprises a wire loop member and is of a resilient nature for the purposes of fitting into the groove in the pin.

9. A traversing yarn guide as set forth in claim 1 wherein the shuttle means comprises a shaped portion and is of a resilient nature for the purposes of fitting into the groove in the pin.

10. A traversing yarn guide as set forth in claim 1 wherein the shuttle means is of a symmetrical configuration relative to the axis of the main body.

11. A traversing yarn guide as set forth in claim 10 wherein the shuttle means has a spherically curved outside contour.

12. A traversing yarn guide as set forth in claim 1 wherein the shuttle means has at least four guide points arranged symmetrically relative to the axis of the main body.

13. A traversing yarn guide as set forth in claim 12 wherein the shuttle means has a spherically curved outside contour.

14. A traversing yarn guide as set forth in claim 1 wherein the shuttle means has a spherically curved outside contour.

15. A traversing yarn guide as set forth in claim 1 wherein the main body is hollow.

* * * * *